US009601064B1

(12) United States Patent
Amarilio

(10) Patent No.: US 9,601,064 B1
(45) Date of Patent: Mar. 21, 2017

(54) LIQUID CRYSTAL DISPLAY WITH FULL DRIVER REDUNDANCY SCHEME

(71) Applicant: ELBIT SYSTEMS LTD., Haifa (IL)

(72) Inventor: Errikos Amarilio, Kiryat Ata (IL)

(73) Assignee: ELBIT SYSTEMS LTD., Haifa (IL)

( * ) Notice: Subject to any disclaimer, the term of this patent is extended or adjusted under 35 U.S.C. 154(b) by 0 days.

(21) Appl. No.: 13/686,959

(22) Filed: Nov. 28, 2012

Related U.S. Application Data

(60) Provisional application No. 61/563,904, filed on Nov. 28, 2011.

(51) Int. Cl.
*G09G 3/36* (2006.01)

(52) U.S. Cl.
CPC ..... *G09G 3/36* (2013.01); *G09G 2310/0278* (2013.01)

(58) Field of Classification Search
CPC ..... G09G 3/36; G09G 2310/0278
See application file for complete search history.

(56) References Cited

U.S. PATENT DOCUMENTS 5,815,129 A * 9/1998 Jung ..... G09G 3/3677 345/100
5,923,512 A * 7/1999 Brownlow ..... G06F 11/2215 324/750.3
6,157,358 A * 12/2000 Nakajima ..... G09G 3/2011 345/209
6,449,768 B1 * 9/2002 Oftedahl et al. ..... 725/119
2002/0075248 A1 * 6/2002 Morita ..... G09G 3/3648 345/204
2003/0038765 A1 * 2/2003 Hiraki ..... 345/87
2003/0095091 A1 * 5/2003 Enomoto et al. ..... 345/87
2006/0164118 A1 * 7/2006 Taguchi ..... G09G 3/3648 324/760.02
2006/0203604 A1 * 9/2006 Park ..... G09G 3/3648 365/185.23
2006/0267913 A1 * 11/2006 Mochizuki ..... G09G 3/3688 345/100
2006/0279514 A1 * 12/2006 Yokota ..... G09G 3/3688 345/100
2007/0046615 A1 * 3/2007 Tsuida ..... G09G 3/3614 345/100
2007/0164972 A1 * 7/2007 Chang ..... G09G 3/3677 345/100
2007/0285596 A1 * 12/2007 Lu et al. ..... 349/59
(Continued)

*Primary Examiner* — Amare Mengistu
*Assistant Examiner* — Crystal A Mathews
(74) *Attorney, Agent, or Firm* — Pearl Cohen Zedek Latzer Baratz LLP

(57) ABSTRACT

A display that supports full redundancy on its array of pixels is provided herein. The display includes an array of wired rows and columns of liquid crystal display (LCD) cells; a primary driver set that includes a plurality of LCD drivers each connected via a respective primary switch to a first end of the wired row or a first end of the wired column; and a secondary driver set that includes a plurality of LCD drivers each connected via a respective secondary switch to a second end of the wired row or a second end of the wired column, wherein the primary switches and the secondary switches are mutually exclusive so that whenever the primary switches are open the secondary switches are closed and vice versa.

20 Claims, 1 Drawing Sheet

(56) References Cited

U.S. PATENT DOCUMENTS

| | | | | |
|---|---|---|---|---|
| 2008/0079001 | A1* | 4/2008 | Umezaki | H01L 27/1214 257/59 |
| 2008/0165110 | A1* | 7/2008 | Kim | H01L 27/1214 345/99 |
| 2008/0224982 | A1* | 9/2008 | Yamazaki | 345/98 |
| 2010/0201902 | A1* | 8/2010 | Hsu | G02F 1/136259 349/54 |
| 2010/0245336 | A1* | 9/2010 | Zhang | G09G 3/3611 345/213 |
| 2011/0148825 | A1* | 6/2011 | Ueno | G09G 3/006 345/204 |
| 2011/0216039 | A1* | 9/2011 | Chen et al. | 345/174 |
| 2011/0234574 | A1* | 9/2011 | Tanaka | G09G 3/2096 345/211 |
| 2012/0098871 | A1* | 4/2012 | Park | G09G 3/3607 345/690 |
| 2013/0176318 | A1* | 7/2013 | Dunn | G09G 3/36 345/501 |

* cited by examiner

LIQUID CRYSTAL DISPLAY WITH FULL DRIVER REDUNDANCY SCHEME

CROSS REFERENCE TO RELATED APPLICATIONS

This application is a non-provisional application claiming priority from U.S. provisional patent application No. 61/563,904, filed on Nov. 28, 2011, which is incorporated by reference in its entirety.

BACKGROUND OF THE INVENTION

1. Technical Field

The present invention relates to liquid crystal displays and more particularly, to such displays usable for large area displays.

2. Discussion of the Related Art

In recent years, there is a growing need to introduce Large Area Displays (LAD) in critical applications. One of the most demanding applications for LAD is in the cockpit of aircraft. There is growing and insatiable need in presenting flight information, navigation information, and sensor and mission information. Traditionally, the classical solution for such cockpits was the use of multiple Multi-Function-Displays (MFD). The installation of multiple displays results in a very rigid layout and formatting of the displayed images. Since the size of the display is given, the information format is given. This method tends to be prohibiting in adding additional images. On the other hand the introduction of Large Area Displays allows the dynamic allocation of display area in accordance with specific needs, as they vary in accordance with the flight stage.

One of the main issues in the use of a single LAD is the issue of redundancy. In the multi display cockpit, if one display fails, there are others that can be used to present the essential information. If a LAD is installed in the cockpit, there is no room for additional displays, so that if it fails there is no imagery to fly the aircraft. In order to overcome this drawback many different redundancy schemes have been developed. Most of the schemes provide a solution on single electronic failures, but they do not provide a a solution on the LCD panel. The most advanced known solutions are those that divide the display area to two separate electronic matrices, so that if one fails, only half the display surface fails.

It would be advantageous to provide a mechanism which retains full redundancy on the LCD level, even if a there is a single LCD failure.

SUMMARY OF THE INVENTION

One aspect of the invention provides a display that supports full redundancy on its array of pixels. The display includes an array of wired rows and columns of liquid crystal display (LCD) cells; a primary driver set that includes a plurality of LCD drivers each connected via a respective primary switch to a first end of the wired row or a first end of the wired column; and a secondary driver set that includes a plurality of LCD drivers each connected via a respective secondary switch to a second end of the wired row or a second end of the wired column, wherein the primary switches and the secondary switches are mutually exclusive so that whenever the primary switches are open the secondary switches are closed and vice versa.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

Figure 1:
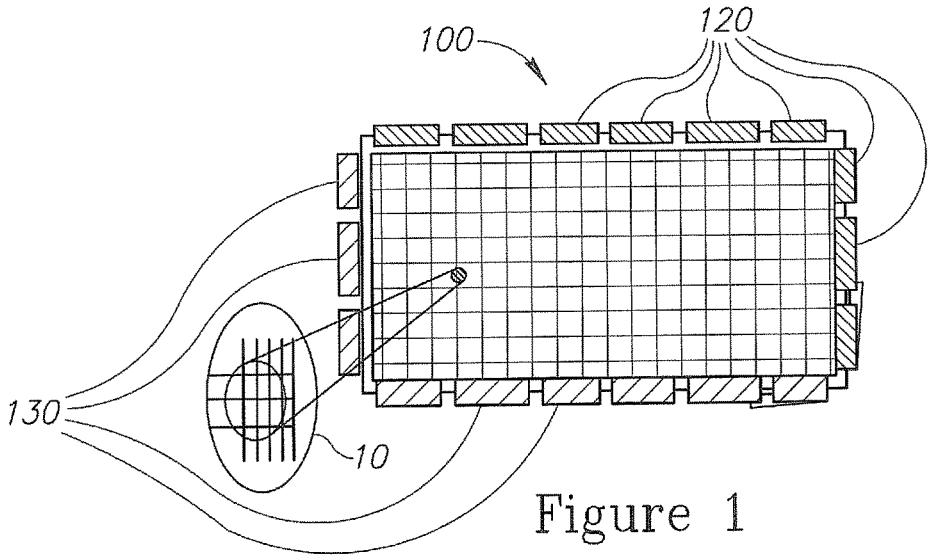
FIG. 1 is a schematic block diagram illustrating an aspect of the invention according to some embodiments.

The drawings together with the following detailed description make apparent to those skilled in the art how the invention may be embodied in practice.

DETAILED DESCRIPTION OF THE INVENTION

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a schematic block diagram illustrating an aspect of the invention according to some embodiments. Display 100 supports full electronic redundancy on the LCD cell. Display 100 includes an array of LCD cells composed of rows and columns of LDC cells as shown in an enlarged set of LCD cells 10. Display 100 includes two sets of drivers (aka TABs), each set mounted on opposing edges of the LCD cell array. The first set is the primary set 120 and the second set is the secondary set 130. Two switches (not shown here) are mounted on each row and on each column in the array, one switch at each entrance of the line from the TABs 120 and 130.

Figure 2A:
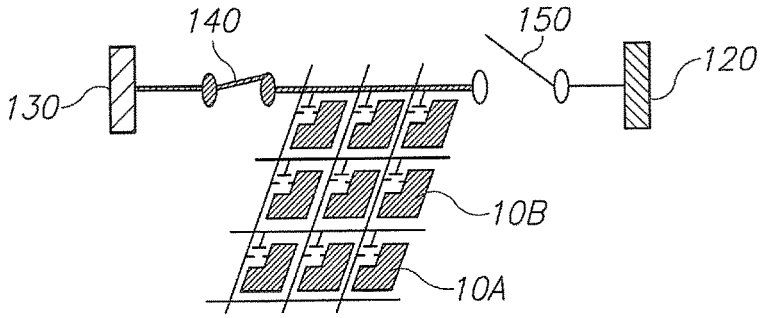
FIGS. 2A and 2B are wiring schemes illustrating an exemplary implementation of the invention according to some embodiments.
Figure 2B:
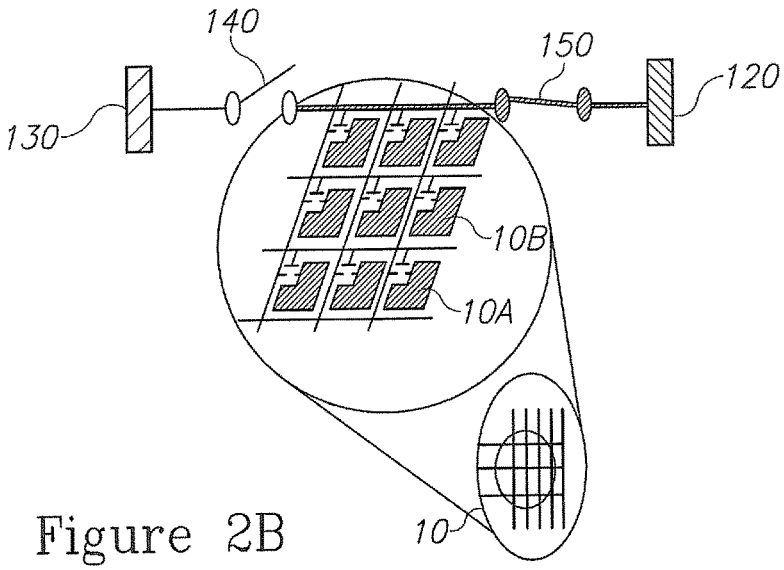

FIGS. 2A and 2B are wiring schemes illustrating an exemplary implementation of the invention according to some embodiments. In an array of LCD based pixels (such as 10A, 10B), a row of wired LCD cells is shown with a driver at each side—a primary driver 120 and a secondary driver 130. Each one of the drivers is electrically coupled to the row of LCD cells via a respective switch: a primary switch 150 and a secondary switch 140. In FIG. 2A primary switch 150 is open whereas secondary switch 140 is closed such that secondary driver 130 controls the pixels on the row. Similarly, in FIG. 2B secondary switch 140 is open whereas primary switch 150 is closed such that primary driver 120 controls the pixels on the rows.

It should be evident that any TAB failure or connection failure between the TAB and the LCD glass, all the way to the switch is fully redundant. Therefore, if any failure occurs in the primary driving set, this failure is bypassed by the secondary driving set.

The Primary/Secondary switches position (open/close) is controlled by the display (LAD or other) redundancy electronics control (not shown), which is beyond the scope of the present invention. Under this scheme, the switches operate in a mutual exclusive manner. Additionally, the display is fully redundant for any single failure, thus there is no dead area on the display active area under any single failure, be it electronic or mechanical TAB/connectors disconnect.

This redundancy scheme is possible with any configuration of custom LCD cell. The implementation of the switches is trivial in the implementation of the LCD active (thin film transistor) TFT matrix. It should be noted that these switches are typically in a constant position and there are no dynamic requirements on their behavior.

In operation, under any electronic failure the LCD image is always presented on the whole display surface. A typical LCD cell consists of an active matrix of transistors. These transistors make the sub-pixel elements of the display. The conductance of these transistors determines the voltage applied to each LCD sub-pixel element, thus determining the transparency of the specific element. When lit by a backlight this transparency value shows as a grey level. All the transistors are connected in a rows/columns matrix, each transistor row is selected by a specific selection voltage on the row lines. When a specific row is selected, the exact required voltage is applied to every column, in order to set the exact brightness for each transistor (sub-pixel) on that row. This process repeats itself for all the rows. When all the rows have been addressed, the process repeats itself thus creating a new frame.

The selecting voltage for the rows and the exact voltage for the columns is generated by the LCD driving electronics. Typically, the driver electronics are integrated circuits, housed on a flex printed circuit board, commonly called a Tab. There are LCD cells where the drivers are mounted on the LCD glass (chip on glass) or are part of the silicon deposited on the glass.

In any configuration potential failures of the driving circuitry or its connection to the rows columns exist. The following scheme provides a redundancy scheme, on the driving electronics and their connections on the rows columns, irrelevant to the exact LCD panel configuration. In the following discussion we use the common Tab driver method, but it should be self evident that the description is valid for other methods of implementing the LCD drivers.

The proposed solution involves the use of dual driver TABS on any single row or column of the LCD matrix and a series switch, controlled by an external mechanism. One of the switches is always closed while the other switch is always open. The default mode of operation is when the first set of switches is closed while the second is open. If any failure happens on the driving electronics or continuity of the TAB conductors to the LCD, than the switches may be toggled and the failure is bypassed by the second set of drivers.

In embodiments, the present invention comprises a method of providing redundancy to a display comprising an array of wired rows and columns of liquid crystal display (LCD) cells, and a primary driver set that includes a plurality of LCD drivers each connected via a respective primary switch to a first end of the wired row or a first end of the wired column.

The method comprises connecting a secondary driver set that includes a plurality of LCD drivers, by connecting each LCD driver via a respective secondary switch to a second end of the wired row or a second end of the wired column, and configuring the primary driver set and the secondary driver set to be mutually exclusive.

The first end of the wired row and the second end of the wired row may be on opposing edges of the array, and the first end of the wired column and the second end of the wired column may be on opposing edges of the array. The mutual exclusivity of the primary switches and the secondary switches may be kept in respect to the respective row or column.

The method may further comprise maintaining the mutual exclusivity of the primary switches and the secondary switches by closing a secondary switch when a corresponding primary switch is open and by closing a primary switch when a corresponding secondary switch is open.

Alternatively, in some embodiments, the use of switches is altogether eliminated and a controller (such as a voltage controller) is used instead. The de facto switching between drivers is carried out by controlling the voltage levels or voltage supply to the drivers.

The method may further comprise operating by default the primary driver set with the primary switches closed, and operating the secondary driver set upon failure of the primary driver set, by closing corresponding secondary switches.

The method may further comprise controlling the primary and secondary driver sets by a display redundancy electronics control.

The array may be a thin film transistor (TFT) matrix and the primary and secondary driver sets may be implemented as integrated circuits, housed on a flex printed circuit board.

In embodiments, the present invention comprises a kit for providing redundancy to a display comprising an array of wired rows and columns of liquid crystal display (LCD) cells, and a primary driver set that includes a plurality of LCD drivers each connected via a respective primary switch to a first end of the wired row or a first end of the wired column.

The kit comprises a secondary driver set that includes a plurality of LCD drivers each connected via a respective secondary switch to a second end of the wired row or a second end of the wired column, wherein the primary switches and the secondary switches are mutually exclusive.

The kit may further comprise a display redundancy electronics control arranged to control the primary and secondary driver sets by maintaining the mutual exclusivity of the primary switches and the secondary switches by closing a secondary switch when a corresponding primary switch is open and by closing a primary switch when a corresponding secondary switch is open.

The kit may be mounted such that the first end of the wired row and the second end of the wired row are on opposing edges of the array and such that the first end of the wired column and the second end of the wired column are on opposing edges of the array.

The mutual exclusivity of the primary switches and the secondary switches may be in respect to the respective row or column. The kit may be mounted such that by default the primary driver set is operative with the primary switches closed, and the display is arranged to operate the secondary driver set upon failure of the primary driver set, by closing corresponding secondary switches.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A liquid crystal display (LCD) comprising:

an array of wired rows and columns of sub pixel transistors;

a primary driver set that includes a plurality of LCD drivers each connected via a respective primary switch to a first end of the wired row or a first end of the wired column;

a secondary driver set that includes a plurality of LCD drivers each connected via a respective secondary switch to a second end of the wired row or a second end of the wired column and;

a controller configured to instruct the secondary driver set to drive the respective sub pixel transistors electrically coupled thereto only whenever the primary driver set in instructed not to drive the respective sub pixel transistors electrically coupled thereto so the driving by the primary and the secondary driver sets is mutually exclusive.

2. The display of claim 1, wherein the first end of the wired row and the second end of the wired row are on opposing edges of the array.

3. The display of claim 1, wherein the first end of the wired column and the second end of the wired column are on opposing edges of the array.

4. The display of claim 1, wherein the mutual exclusivity of the primary switches and the secondary switches is in respect to the respective row or column.

5. The display of claim 1, further arranged to maintain the mutual exclusivity of the primary switches and the secondary switches by closing a secondary switch when a corresponding primary switch is open and by closing a primary switch when a corresponding secondary switch is open.

6. The display of claim 1, wherein by default the primary driver set is operative with the primary switches closed, and the display is arranged to operate the secondary driver set upon failure of the primary driver set, by closing corresponding secondary switches.

7. The display of claim 1, further comprising a display redundancy electronics control arranged to control the primary and secondary driver sets.

8. The display of claim 1, wherein the array is a thin film transistor (TFT) matrix.

9. The display of claim 1, wherein the primary and secondary driver sets are integrated circuits.

10. A method of providing redundancy to a liquid crystal display (LCD) comprising: an array of wired rows and columns of sub pixel transistors, and a primary driver set that includes a plurality of LCD drivers each coupled to a first end of the wired row or a first end of the wired column, the method comprising:

connecting a secondary driver set that includes a plurality of LCD drivers, by connecting each LCD driver to a second end of the wired row or a second end of the wired column, and instructing the secondary driver set to drive the respective sub pixel transistors electrically coupled thereto only whenever the primary driver set in instructed not to drive the respective sub pixel transistors electrically coupled thereto so the driving by the primary and the secondary driver sets is mutually exclusive.

11. The method of claim 10, wherein the first end of the wired row and the second end of the wired row are on opposing edges of the array.

12. The method of claim 10, wherein the first end of the wired column and the second end of the wired column are on opposing edges of the array.

13. The method of claim 10, wherein the mutual exclusivity of the primary driver and the secondary switches is in respect to the respective row or column.

14. The method of claim 10, further comprising maintaining the mutual exclusivity of the primary driver and the secondary driver by closing a secondary switch when a corresponding primary switch is open and by closing a primary switch when a corresponding secondary switch is open.

15. The method of claim 10, further comprising operating by default the primary driver set with the primary switches closed, and operating the secondary driver set upon failure of the primary driver set, by closing corresponding secondary switches.

16. The method of claim 10, further comprising controlling the primary and secondary driver sets by a display redundancy electronics control.

17. The method of claim 10, wherein the array is a thin film transistor (TFT) matrix.

18. The method of claim 10, further comprising implementing the primary and secondary driver sets as integrated circuits.

19. A kit for providing redundancy to a liquid crystal display (LCD) comprising an array of wired rows and columns of sub pixel transistors, and a primary driver set that includes a plurality of LCD drivers each connected via a respective primary switch to a first end of the wired row or a first end of the wired column, the kit comprising:

a secondary driver set that includes a plurality of LCD drivers each connected via a respective secondary switch to a second end of the wired row or a second end of the wired column; and a controller configured to instruct the secondary driver set to drive the respective sub pixel transistors electrically coupled thereto only whenever the primary driver set in instructed not to drive the respective sub pixel transistors electrically coupled thereto so the driving by the primary and the secondary driver sets is mutually exclusive.

20. The kit of claim 19, further comprising a display redundancy electronics control arranged to control the primary and secondary driver sets by maintaining the mutual exclusivity of the primary switches and the secondary switches by closing a secondary switch when a corresponding primary switch is open and by closing a primary switch when a corresponding secondary switch is open.

* * * * *